US007405410B2

(12) United States Patent
Morehouse

(10) Patent No.: US 7,405,410 B2
(45) Date of Patent: Jul. 29, 2008

(54) METHOD AND APPARATUS FOR CONFINING, NEUTRALIZING, COMPRESSING AND ACCELERATING AN ION FIELD

(76) Inventor: Mark Morehouse, 2408 Carlton Pl., Costa Mesa, CA (US) 92627

( * ) Notice: Subject to any disclaimer, the term of this patent is extended or adjusted under 35 U.S.C. 154(b) by 237 days.

(21) Appl. No.: 11/486,674

(22) Filed: Jul. 14, 2006

(65) Prior Publication Data

US 2008/0073552 A1 Mar. 27, 2008

(51) Int. Cl.
*H01J 1/50* (2006.01)

(52) U.S. Cl. ..... 250/396 ML; 250/423 R; 250/423 F; 250/288; 250/281; 313/231.31; 315/111.21; 315/111.71

(58) Field of Classification Search ..... 250/251, 250/281, 283, 285, 288, 290, 396 ML, 423 F, 250/423 R, 433; 315/111.01, 111.21, 111.71, 315/111.81, 111.91; 313/231.01, 231.31
See application file for complete search history.

(56) References Cited

U.S. PATENT DOCUMENTS 1,948,384 A 2/1934 Lawrence
3,120,475 A 2/1964 Bennett
3,527,977 A 9/1970 Ruark
4,156,828 A * 5/1979 Maisenhalder et al. . 315/111.91
4,788,024 A 11/1988 Maglich et al.
5,034,183 A 7/1991 Blewett
5,162,094 A * 11/1992 Curtis ..... 376/107
5,182,496 A * 1/1993 Manheimer et al. .... 315/111.41
2005/0253089 A1* 11/2005 Maeno et al. ..... 250/491.1

* cited by examiner

*Primary Examiner*—Jacob Y. Choi
*Assistant Examiner*—Brooke Purinton
(74) *Attorney, Agent, or Firm*—Gene Scott; Patent Law & Venture Group

(57) ABSTRACT

An apparatus and method of use for injection, confinement, neutralization, acceleration and compression of an ion field using a solenoid having an axis of symmetry and supported within a vacuum space. A pair of magnetizable elements are positioned initially in spaced apart positions within the solenoid and after the solenoid is filled with ions from an ion source, the magnetizable elements are brought into close proximity to compress the ion field and accelerate its ions.

10 Claims, 2 Drawing Sheets

METHOD AND APPARATUS FOR CONFINING, NEUTRALIZING, COMPRESSING AND ACCELERATING AN ION FIELD

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to systems for ion field experimentation, and more particularly to such a system having a method and apparatus for injecting, confining, compressing, neutralizing, and accelerating an ion field.

2. Description of Related Art Including Information Disclosed Under 37 CFR 1.97 and 1.98

Lawrence, U.S. Pat. No. 1,948,384, discloses a means for causing ions to travel in curved paths back and forth between a single pair of electrodes. The ions move in paths effected by the action of a magnetic field, by means of which the ions are deflected so that their motion is repeatedly reversed with reference to the electric field between electrodes and the voltage of such electrodes oscillates in synchronism with the reversal of the path of the particles. Bennett, U.S. Pat. No. 3,120,475, discloses a method of producing thermonuclear generation of power which comprises applying a magnetic field in a chamber symmetric about an axis of the chamber, applying an electrical field about the magnetic field symmetric with the axis, applying a positive potential to a first electrode and a negative potential to a second electrode both of which are positioned along the axis of the chamber with one each of the first and second electrodes positioned at opposite ends of the chamber and, injecting ions into the magnetic field at a position which is off the center of the magnetic field and off the axis of the chamber whereby the injected ions are curved into an orbit about the magnetic lines of force of the applied magnetic field, while advancing around the longitudinal axis of the magnetic lines of force and moving back and forth past the mid-plane of the applied field causing ion collisions near the axis of the chamber. Ruark, U.S. Pat. No. 3,527,977, discloses a method whereby an energetic oscillating stream of electrons in a confining magnetic field within an evacuated enclosure, and injecting one or more beams of energetic molecular ions into the interior of the enclosure and into the path of the stream of electrons where a portion of the molecular beam is dissociated and/or ionized by the stream of energetic electrons, to thereby form a hot plasma of ionized particles. When particles are injected with sufficient energy into a region containing relatively stationary electrons, it is possible for the electrons to excite or ionize the particles. In the case of molecular particles, excitation to a "repulsive" state leads directly to dissociation. Excitation to an "attractive" state on the other hand, leads to easy ionization in a subsequent collision. This is possible because molecules or atoms, in the excited state, have lower ionization energies, and the cross section for ionization is, in general, several times larger for the excited state than for the equivalent entity in the stable state. The metastable two-quantum state of the hydrogen atom is of particular interest since these metastable atoms have a life long enough to permit further excitation and eventual ionization. Maglich et al, U.S. Pat. No. 4,788,024 discloses a self-colliding particle beam apparatus capable of increasing stored ion density by a factor of 10 and increasing ion confinement time by a factor of 10 to thereby increase the collisional energy between particles. The self-collider comprises essentially a superconducting magnet, an ultra-high vacuum system and an electrostatic stabilizer. The self-collider apparatus can be employed as part of a beam energy multiplier by combining it with an injector, including an ion source, an accelerator and a beam transport system. By increasing the stored ion density by a factor of 10 and by increasing the ion confinement time by a factor of 10, the increase in collisional probability between two particles increases by a factor of 1,000. If the masses of the particles in the beam are all the same, then the energy increase is up to a factor of 4 as calculated by the formula (1+M.sub.1/M.sub.2) .sup.2. Blewett, U.S. Pat. No. 5,034,183 discloses an apparatus for increasing the collisions of nuclear particles in a "migma" type device. This device employs ring magnets to reflect ions of energies coming from the ring axis back to the ring axis on orbits that precess around the axis. In this manner collisions can be made to occur at rates which are high enough to yield useful quantities of energy or other desired products.

The related art described above discloses apparatus and methods for manipulating ions to meet various objectives including increasing nuclear collisions, increasing ion density and confinement time, controlled ionization and dissociation of molecules, and for producing thermonuclear generation of electrical power. However, the prior art fails to disclose the present relatively simple magnetic bottle and technique for accelerating ions in a compressed ion field suitable for experimentation in confinement and ionizations studies. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A method and apparatus for injection, confinement, neutralization, acceleration and compression of an ion field using a solenoid having an axis of symmetry and supported within a vacuum space. In a preferred embodiment, a pair of magnetizable elements are positioned initially in spaced apart positions within the solenoid and after the solenoid is filled with ions from an ion source, the magnetizable elements are brought into close proximity to compress the ion field and accelerate its ions.

A primary objective inherent in the above described apparatus and method of use is to provide advantages not taught by the prior art.

Another objective is to provide a relatively simple device for causing an ion beam to be captured in well defined orbits, densified and compressed.

A further objective is to provide such a device for causing ions of the ion field to experience significant accelerations.

A still further objective is to provide such a device capable of establishing an ion field suitable for experimental evaluation.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE DRAWINGS

The present invention is illustrated in the accompanying drawings.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
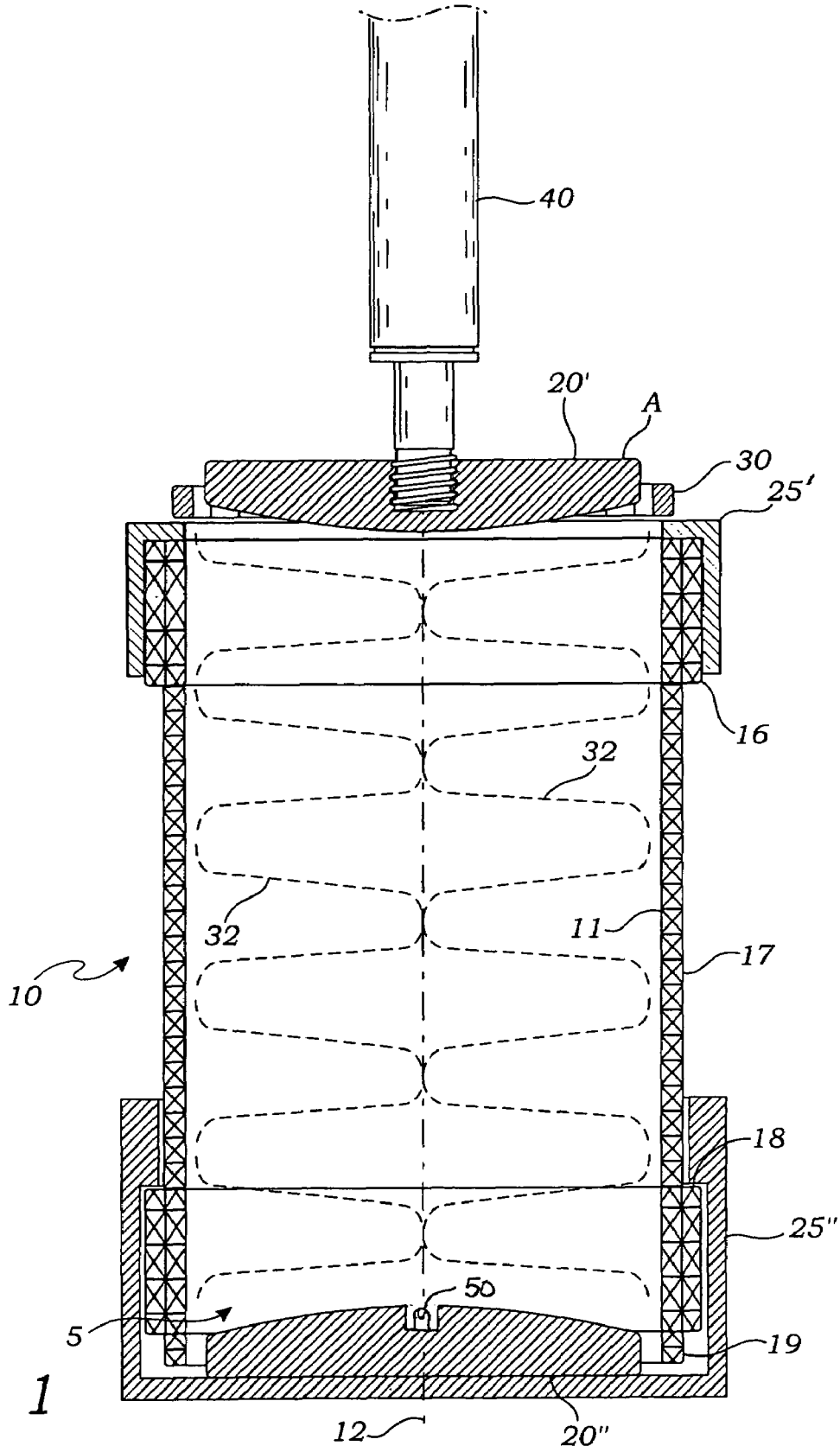
FIG. 1 is a cross-sectional view of the present apparatus showing a movable element of the invention in an initial position.

Described now in detail is a method and apparatus useful for confinement, acceleration, neutralization and compression of an ion field 5 in a vacuum space. As shown in FIG. 1, the apparatus includes a solenoid 10 having an axis of symmetry 12, a proximal end defined by element 30, and a distal end defined by element 20". A proximal magnetizable element 20' and a distal magnetizable element 20", each being preferably electromagnets, high-mu magnetizable cores, permanent magnets or a combination of these are positioned initially in spaced apart opposition on the axis of symmetry 12 as shown in FIG. 1. Element 20' is positioned proximally and element 20" is positioned distally relative to solenoid 10 as shown.

An ion source 30 is a plasma generator from which ions may be extracted and accelerated in a chosen direction. Several types of ion sources are used today including those that use RF, Penning, Plasmatron, multiple confinement, electron-cyclotron resonance (ECR) and electron beam techniques. In the present apparatus a ring shaped ion source 30 is positioned proximally, as shown, so as to project a cylindrical stream of ions 32 into the interior of solenoid 10, thereby establishing the ion field 5 between the magnetizable elements 20' and 20" and bounded by the interior surface 11 of solenoid 10. The ion source 30 is preferably made up of modified linear ion beam sources of the type commercially available from Ion Tech, Inc. of Ft. Collins, Colo., model number 0666RF, which produces a 1000 ma ion current projected in a 66 cm linear format in a selected direction. Such an ion source can be easily modified to produce an arc shaped discharge and when arranged with other similar sources, they may form a continuous circular discharge as is used in the preferred embodiment. The ion source technology is well developed and is referenced to U.S. Pat. Nos. 5,973,447 and 6,086,962 which are hereby incorporated herein by reference. In the present application the circular ion beam is directed through an annular gap between the proximal magnetizable element 20' on one side of the annular gap, and an annular high-mu collar 25' and the solenoid 10 on the other side of the annular gap.

A proximally positioned drive 40 is preferably engaged with proximal magnetizable element 20', as shown, and is enabled for moving magnetizable element 20' axially toward fixed element 20", element 20' being of such size as to fit into and move within solenoid 10. The drive 40 may be a motor driven lead screw, a pneumatic or hydraulic driven extensor (as shown), or any other well known mechanical linear drive system of sufficient force and structural integrity as to fulfill the objectives defined above.

Figure 3:
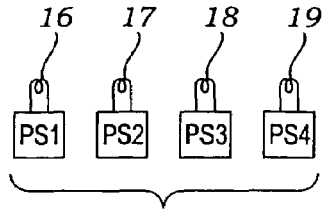
FIG. 3 is a schematic view of a plurality of power supplies.

The solenoid 10 comprises segments arranged axially in side-by-side positions as shown in FIG. 1, preferably from the proximal end of solenoid 10 to the distal end, and includes: a proximal magnetizing coil 16, a storage coil 17, a multifunction coil 18 and a distal magnetizing coil 19. These segments 16-19 of solenoid 10 are each individual and independent solenoids and are preferably controlled as to their magnetizing currents by separate power supplies PS1, PS2, PS3 and PS4 as shown in FIG. 3. Therefore, "solenoid 10", in this writing, is merely a shorthand for discussing the segments 16-19 as a collection. However, solenoid 10 may comprise any number of separate coils.

In a preferred embodiment, the magnetizable elements 20' and 20" are positioned symmetrically on the axis of symmetry 12 and more preferably are coaxial therewith. However, the elements 20' and 20" may alternately be positioned asymmetrically with respect to the axis of symmetry 12.

As stated above, the ion source 30 may comprise a single source, several sources or a plurality of ion sources and if formed as a plurality of ion sources, they may be arranged in a pattern such as a circle or oval. As can be seen in FIG. 1, the ions 32 are directed through the annular gap between the first magnetizing coil 16 and the proximal magnetizable element 20'. If plural sources are used, they may be arranged to form a closed figure such as a circle or similar shape to provide plural streams of ions arranged around the annular gap and into solenoid 10. The objective here is to produce accelerated ions that optimally move from the ion source(s) 30 into the space between the magnetizable elements 20' and 20", which space is bounded by the interior surface 11 of solenoid 10 so as to form the ion field 5. As shown in FIG. 1 the ions 32 once within the solenoid 10 are influenced by the axial magnetic field of the solenoid 10, due to their charge, to move cyclonically as shown.

The present apparatus may be operated without the two magnetizable elements 20' and 20" by merely accelerating the ions 32 into solenoid 10 from the ion source 30 wherein the ions 32 are trapped by a means for trapping the ions 32 such as a significantly more highly energized proximal and distal coil segments 16 and 19 respectively, which create a mirror field at both ends of solenoid 10. A means for space charge neutralization 50 is preferably provided as shown in FIG. 1 as a coil or filament mounted in the distal magnetizable element 20" and is within the magnetic field of the solenoid 10. This placement of the neutralizing means 50 is novel and advantageous in providing an efficient neutralizing of the space charge within the solenoid 10. This coil is an electron emitter and is ignited by an electrical circuit (not shown). The ion field may be compressed by sequentially energizing the several separate coils that make up solenoid 10 to drive the ions toward element 20". However, the preferred manner of compressing the ions 32 will be described below.

Figure 2:
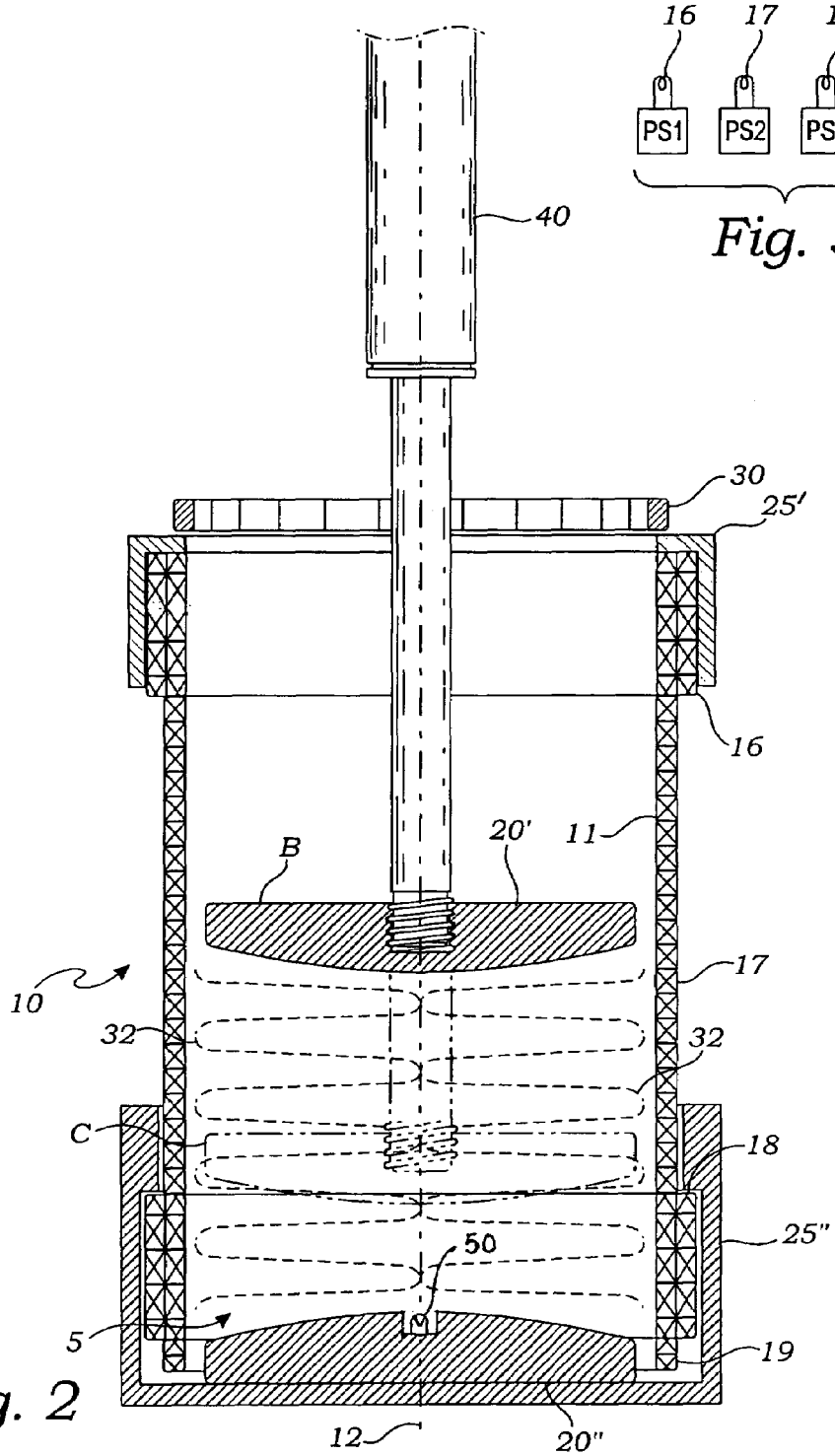
FIG. 2 is the same view as FIG. 1 showing in solid line an advanced medial position of the movable element, and in phantom line a terminal position of the movable element.

The above described apparatus is operated to produce injection, confinement, acceleration and compression of the ion field 5. In the preferred method the solenoid 10 is energized to create an axial magnetic field aligned with the axis of symmetry of solenoid 10 as is typical and well known. The distal magnetizable element 20" is magnetized by the distal magnetizing coil 19 to form a first magnetic mirror at the distal end of solenoid 10. Ions 32 are injected into the solenoid 10 axially from the ion source 30 peripherally past the proximal magnetizable element 20' and toward the distal magnetizable element 20" which, as stated, functions as a magnetic mirror during this process, i.e., filling of the solenoid 10 with ions. The ions 32 move in fixed radiuses with respect to the common axis 12 through a radial magnetic cusp field established between the proximal magnetizable element 20' and the high-mu collar 25' which is positioned around the outer distal aspect of the proximal coil 16, and this results in a selected amount of the injected ion beam axially directed energy being converted into azimuthally directed energy. This establishes a well organized self-colliding energetic beam of low entropy ions 32 spiraling within the storage coil 17 where at axially distant positions, the ions 32 encounter a stronger magnetic field strength which is established by the distal magnetizable element 20" and its associated coil 19, whereupon, the ions 32 are reflected back toward the ion source. This continues as the solenoid 10 fills until a desired ion density is reached in the ion field 5, and then the proximal magnetizing coil 16 is energized causing the proximal magnetizable element 20' to form a second magnetic mirror. The ion field 5, at this time, is trapped within solenoid 10 between elements 20' and 20". The proximal magnetizable element 20' is now driven into solenoid 10 as shown in FIG. 2 in position "B" and finally into adjacency with the distal magnetizable element 20" by drive 40 as shown as phantom position "C", thereby accelerating and compressing the ion field 5. The proximal magnetizable element 20' is initially in position "A" until solenoid 10 is filled with ions 32, and then it is moved linearly through medial positions exemplified by position "B" and finally into position "C" wherein the magnetizable element 20' completes the magnetic circuit formed by elements 20" and high-mu collar 25" and whereby maximal ion field compression is achieved. Multifunction coil 18 is energized to further compress, monitor, and/or extract energy from the densified ion field 5. Clearly, the above method may be repeated in recursive cycles as desired.

In the above description, to more easily relate the elements described to those shown in the drawing figure, the words, "proximal" and "distal" are used. However, these words may be interchanged with "first" and "second" or "primary" and "secondary," and so on, without loss of intrinsic meaning, and in the following claims, the more general "first" and "second" are used to distinguish between elements of the invention.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

SEQUENCE LISTING

Not applicable.

What is claimed is:

1. An apparatus for confining, neutralizing, compressing and accelerating an ion field in a vacuum space, the apparatus comprising: a solenoid energized for producing a magnetic field therein, the solenoid and the magnetic field having a common axis of symmetry; a pair of magnetizable elements positioned initially in distal opposition on the axis of symmetry; at least one ion source enabled and positioned to project a stream of ions into the solenoid, thereby establishing the ion field between the pair of magnetizable elements; a drive engaged with at least one of the magnetizable elements enabling the distance therebetween to be controlled; and a means for space charge neutralization, wherein the drive is energized to close the distance between the magnetizable elements thereby accelerating and compressing the ion field.

2. The apparatus of claim 1 wherein the magnetizable elements are each at least one of electromagnets, permanent magnets and magnetizable cores.

3. The apparatus of claim 1 wherein the solenoid comprises segments arranged in order including: a first magnetizing coil, a storage coil, an multifunction coil and a second magnetizing coil; and a means for separately controlling the electric current within each of the segments.

4. The apparatus of claim 1 wherein the magnetizable elements are positioned symmetrically with respect to the axis of symmetry.

5. The apparatus of claim 1 wherein the magnetizable elements are positioned asymmetrically with respect to the axis of symmetry.

6. The apparatus of claim 1 wherein the ion source comprises a plurality of ion sources arranged in a closed circuit.

7. The apparatus of claim 1 wherein an electron emitter is positioned within the magnetic field.

8. A method for confining, neutralizing, compressing and accelerating an ion field in a vacuum space, the method comprising the steps of:

a) providing a solenoid having an axis of symmetry; a pair of magnetizable elements positioned initially at a fixed distance therebetween on the axis of symmetry; an ion source; a drive engaged with at least one of the magnetizable elements; and a means for space charge neutralization;

b) energizing the solenoid to create an axial magnetic field therewithin for receiving ions emitted by the ion source;

c) axially magnetizing a first one of the pair of magnetizable elements thereby forming a first magnetic mirror at a distal end of the solenoid;

d) energizing the space charge neutralization means;

e) injecting the ions into the solenoid axially toward the first magnetic mirror until a selected ion density is reached within the solenoid;

f) axially magnetizing a second one of the pair of magnetizable elements thereby forming a second magnetic mirror at a second end of the solenoid; and g) energizing the drive to close the distance between the magnetic mirrors thereby accelerating and compressing the ion field;

h) energizing the drive to open the distance between the magnetic mirrors, and demagnetizing the second one of the pair of magnetizable elements, thereby resetting initial conditions.

9. The method of claim 8 further comprising the step of establishing the ion source as a plurality of ion sources and arranging the ion sources in a closed circuit.

10. The method of claim 8 further comprising the steps of (e) through (h) in recursive cycles.

* * * * *